United States Patent [19]

Zeller et al.

[11] 4,258,616

[45] Mar. 31, 1981

[54] AIR OUTLET FOR ROOM VENTILATION

[75] Inventors: Adalbert Zeller; Wolfgang Ruf, both of Kolbingen, Fed. Rep. of Germany

[73] Assignee: Schako-Metallwarenfabrik, Ferdinand Schad GmbH, Kolbingen, Fed. Rep. of Germany

[21] Appl. No.: 84,952

[22] Filed: Oct. 15, 1979

[51] Int. Cl.[3] ..... F24F 13/10

[52] U.S. Cl. ..... 98/40 D; 98/40 VT; 98/41 SV; 239/562; 239/590

[58] Field of Search ..... 98/40 R, 40 D, 40 V, 98/40 VT, 40 N, 41 FV; 236/49; 239/553, 562, 563, 590

[56] References Cited

U.S. PATENT DOCUMENTS 3,223,019 12/1965 Schuh ..... 98/40 D

FOREIGN PATENT DOCUMENTS 2002451 9/1971 Fed. Rep. of Germany ..... 98/40 D
2413302 9/1975 Fed. Rep. of Germany ..... 98/40 D
1470139 4/1977 United Kingdom ..... 98/40 D

*Primary Examiner*—Lloyd L. King

*Assistant Examiner*—Harold Joyce

*Attorney, Agent, or Firm*—Blair, Brown & Kreten

[57] ABSTRACT

An air outlet for the admission of conditioned air to rooms and other inhabited spaces includes an air box with an air outlet slot. The air outlet slot is longitudinally subdivided to form individual ducts each of which contains an independently adjustable air guide vane. Internally, the outlet slot may be variably obturated by three superimposed control slides, each of which has periodically occurring covering surfaces, the width of which corresponds to the width of an air outlet duct. The covering surfaces on each control slide are disposed at a distance corresponding to four duct widths. The air box contains thermostatically controlled actuators which are coupled to the control slides in such a way as to permit their relative longitudinal, i.e., axial, displacement when a first control slide is moved between positions corresponding, respectively, the second and/or third control slides are partially carried along so as to define configurations resulting in a variation of the volumetric air flow but maintaining the speed of the emerging air constant.

9 Claims, 5 Drawing Figures

AIR OUTLET FOR ROOM VENTILATION

FIELD OF THE INVENTION

The invention relates to the ventilation of rooms, buildings and other inhabited spaces. More particularly, the invention relates to the disposition and internal construction of air outlets through which hot or cold air is admitted for the purpose of adjusting and regulating the climate of the interior spaces.

BACKGROUND OF THE INVENTION AND PRIOR ART

In a known air outlet for climate control, and described in the German laid-open application OS No. 25 25 196, the air to be admitted to the room travels from a supply channel into a distributor box and passes into the room in a uniform manner through the entire length of the outlet slot of the distribution box. The outlet slot is subdivided into individual ducts each of which contains separately adjustable air guide vanes. The possibility of individually adjusting the air guide vanes of the separate ducts makes it possible to provide for uniform flow of air into the room under varying operational conditions.

The manner in which ventilating air is admitted to a room or other interior space demands advantageously on the type of conditioning that is required. For example, if it is desired to cool a room, it is advantageous to prevent inflow of air into the chamber at angles greater than 45° from the wall so as to avoid unpleasant sensations of cool drafts.

On the other hand, if the space is to be heated, it is more advantageous to inject the warm air substantially perpendicular to the surface of the wall or ceiling of the room so as to insure its proper penetration into the prevailing atmosphere.

Also known in conjunction with modern air conditioning systems is a temperature control based on a change of the admitted air volume that permits an operation with the lowest possible energy losses. In this system, the main channel of the ventilating system is maintained at constant temperature, either on the basis of information regarding the external ambient temperature or regarding the temperature of a control chamber. The constant conduit temperature is chosen to lie in a range extending from the external or control temperature to a value 8° K. below that temperature in the summer time, whereas in the winter season, the range extends from the external temperature or control temperature up to 5° K. above that temperature. The air at this chosen temperature is then supplied to the various spaces to be conditioned through the prevailing air outlets.

During the operation of the system, the thermal load may change, for example because heat-generating machinery is turned off or persons leave the space, causing the temperature of the conditioned space to become too low in the summer time. Conversely, if the thermal load increases, the space would be heated to an excessive temperature in the winter time. To prevent such occurrences, the air volume supplied to the individual spaces through the air outlets is controlled by thermostats and is adapted to the prevailing changes in thermal load. However, these changes in the air volume can be accomplished in the known air outlets having constant exit orifices only with a significant disadvantage. That disadvantage consists of the fact that a decrease in the air volume necessitates a reduction in the velocity of the air jets leaving the orifice. As a consequence, during a cooling process, the air jets tend to bend away from the surface from which they are emerging, in particular the ceiling of the space being conditioned and thus cause the aforementioned undesirable cool drafts. In the heating mode, the lowered air velocity prevents a sufficiently deep penetration of the heated air into the occupied space.

OBJECT AND SUMMARY OF THE INVENTION

It is thus a principal object of the present invention to provide an air outlet for use with air conditioning and ventilating systems which permits changes in the air volume admitted to the conditioned space in accordance with variations in thermal load but without causing substantial changes in the exit velocity of the air being admitted to the space.

This object is attained according to the invention by providing an air outlet in which an outlet slot is subdivided into ducts each of which contains individually adjustable air guide vanes and in that there is provided a plurality of parallel slides extending in the direction of the axis of the air outlet slot and capable of mutual sliding displacement, each of the slides having openings which correspond in size to the cross section of the aforementioned ducts. Furthermore, each of the slides contains duct covering portions which are disposed at distances equal to the fourfold axial extent of each duct.

In an advantageous feature of the invention, the multiple slides are attached to a number of sliding actuator plates which are suitably coupled to the cover slides so as to obtain the desired outlet configuration. The actuator plates in turn are displaced by powered actuators under the control of the temperature control system.

Due to the disposition of the multiple control slides, the effective air outlet cross section of the outlet slot can be adapted to the prevailing change in air volume so that, independently of the change in volumetric flow rate, the air flow rate per effective cross-sectional area is constant which insures that the outlet velocity of the air is also constant. Accordingly, cold air jets do not bend away from the outlet surface, for example the ceiling of the room and warm air jets retain a constant depth of penetration into the air space of the room whose temperature is being controlled. By suitable association of the covering surfaces of the control slides with respect to the ducts of the outlet slot, the air blown into the space is uniformly distributed in spite of changes in the volumetric rate. This purpose is accomplished by adjustment of the air guide vanes in such a way that alternating vanes guide air in a direction substantially tangential to the surface, for example the ceiling of the room, and vertically thereto. By displacing the control slides, it is possible to cause continuously varying obturation of the same number of ducts with differently oriented air guide vanes. The remaining open ducts still exhibit the same proportion of differently oriented air guide vanes.

A particularly suitable embodiment is one which employs three control slides. One control slide serves to open or close ducts having air guide vanes permitting air flow perpendicular to the ceiling or wall of the room. That slide serves primarily for changeover from the summer season in which no warm air is admitted perpendicularly to the winter season in which the admission of warm air takes place.

The remaining control slides of this particular embodiment may be displaced axially with respect to the first control slide. It is a feature of the invention that the remaining control slides are moved forcibly by movement of the first control slide from summer to winter operation without thereby changing the effect upon the volumetric flow rate.

The different control slides are displaced by means of sliding plates to which the control slides are attached by tabs. The sliding plates are disposed in the distribution box, substantially perpendicular to the plane of the control slides and are moved by thermostatically controlled actuators. Preferably, the actuators are also disposed within the air distribution box, thereby permitting a compact construction of the entire air outlet and making possible simple assembly and installation with minimum space requirements within the ceiling or wall space of the room.

Other features and advantages of the air outlet according to the invention will emerge from the detailed description of a preferred exemplary embodiment which relates to the drawing.

DESCRIPTION OF THE PREFERRED EMBODIMENT

Figure 1:
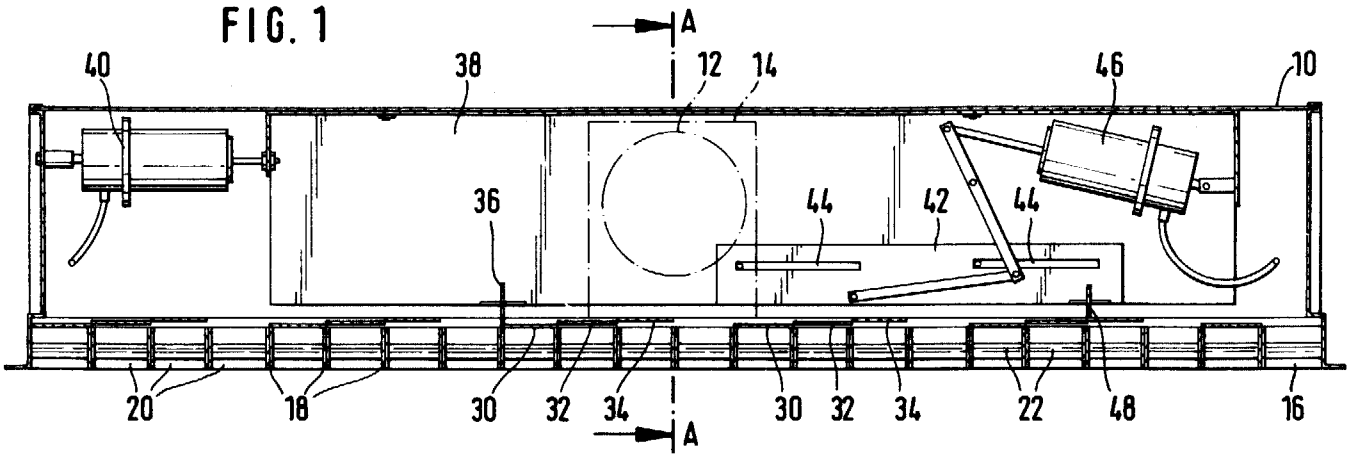
FIG. 1 is an axial section through an air outlet according to the invention along the line B—B of FIG. 2.
Figure 2:
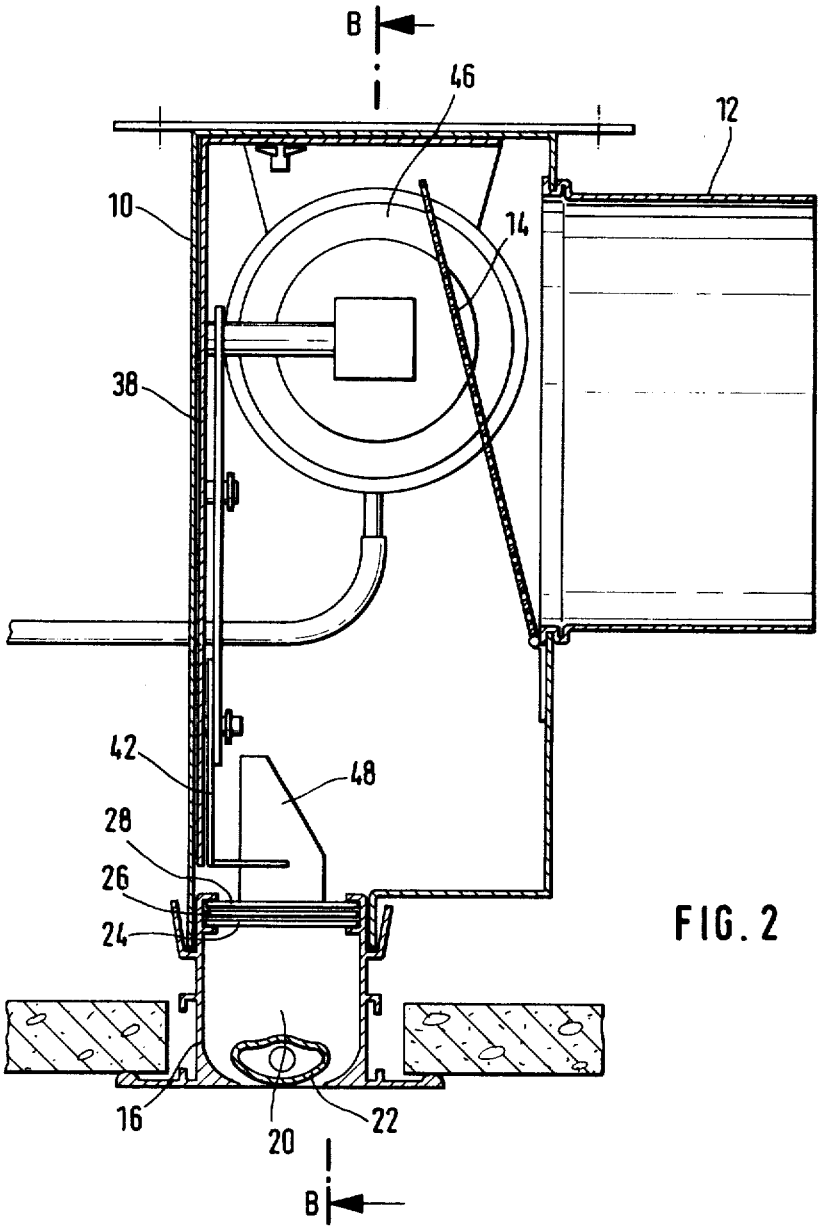
FIG. 2 is a cross section through the air outlet of the invention along the line A—A of FIG. 1.

As illustrated in FIGS. 1 and 2, the air outlet according to the invention includes an extended rectangular distribution box 10 which receives conditioned or heated air through a supply boss 12 from an air supply conduit of the heating and air conditioning system, which is not shown. A control flap 14 embodied as a perforated plate serves to distribute the air arriving through the boss 12 evenly.

Communicating with the distribution box 10 is an outlet slot or opening 16 extending over the entire length of the distribution box 10 and terminating in the room or space to which air is to be admitted. The outlet slot 16 is subdivided into individual ducts 20 by transverse dividers 18. The flow of air through the ducts is perpendicular to the longitudinal extent of the distribution box 10. A shaft extending over the entire length of the outlet slot 16 carries individual air guide vanes 22 for each of the ducts 20. The air guide vanes are located immediately ahead of the outlet opening of each of the ducts 20 and are individually and independently pivotable so as to direct the air stream emerging from each of the ducts 20 in entirely independent ways.

Internally, the outlet slot 16 is associated with three superimposed control slides 24, 26 and 28. These control slides glide in guides at the edges of the slot 16 and are thus capable of mutual and relative displacement with respect to one another and with respect to the outlet slot 16. Each of the control slides 24, 26 and 28 extends over the entire length of the outlet 16 and each of the control slides has obturating surfaces 30, 32 and 34, respectively, capable of closing off one of the ducts 20 and disposed in each case at a distance equal to four widths of a duct 20. Accordingly, the duct cover surfaces 30 of the duct 24 are capable of obturating every fourth duct 20 while leaving the three intervening ducts open. Similar considerations apply to the control slides 26 and 28 and their closing surfaces 32, 34. The first control slide 24 is fastened to a first sliding plate 38 by a bracket 36, while the plate 38 is capable of axial displacement within the air box 10. Further disposed within the air box 10 is a thermostatically controlled actuator 40 which is capable of moving the plate 38 and thus the first control slide 24 by one duct width.

Disposed on the first plate 38 is a second plate 42 capable of relative displacement with respect to the plate 38 by two duct widths via a guide slot 44. The second plate 42 is displaced by a second thermostatically controlled actuator 46 which is mounted on the first plate 38.

The third control slide 28 is attached to the second plate 42 by a bracket 48. Thus the third control slide may be displaced with respect to the first control slide mounted on the first plate 38 by two duct widths under the control of the actuator 46 and the second sliding plate 42.

Figure 3:
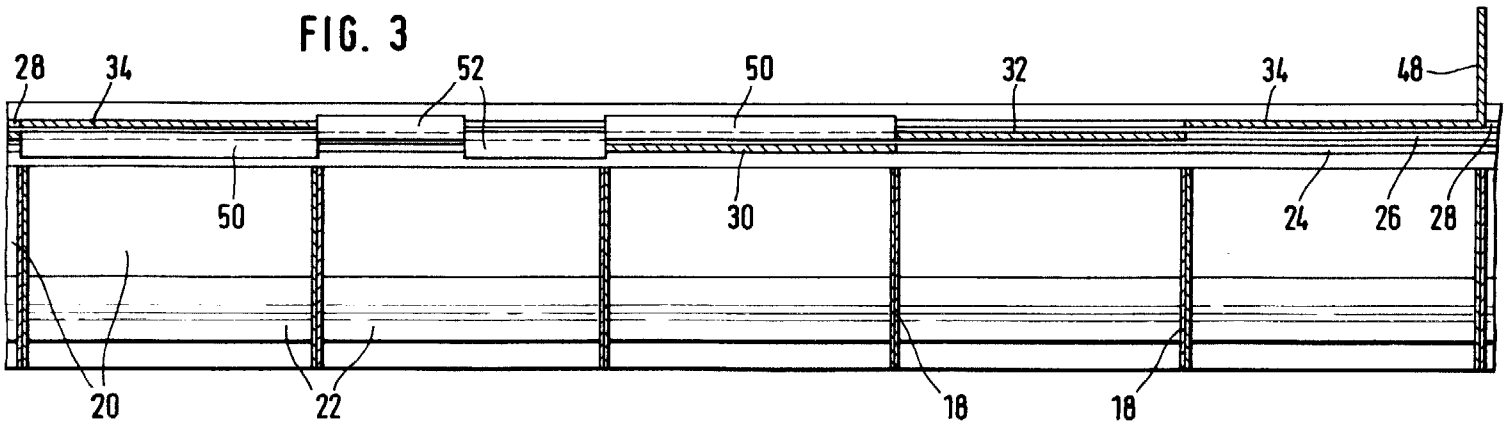
FIG. 3 is an enlarged detail of FIG. 1.

As best seen in FIG. 3, the second control slide 26 has two pairs of catch tabs 50 and 52. The tabs 50 extend in the axial direction over one duct width and are displaced with respect to one another by two duct widths. The tab 50 in the left of the figure extends downwardly and engages the first control slide 24 whereas the tab 50 lying to the right in the figure extends upwardly and engages the third control slide 28. The two tabs 52 are disposed between the tabs 50 and extend axially over one-half duct width. The left tab 52 engages the third control slide 28 while the right tab 52 extends downwardly and engages the first control slide 24.

The function of the air outlet described above is as follows (see FIGS. 4 and 5).

Figure 4:
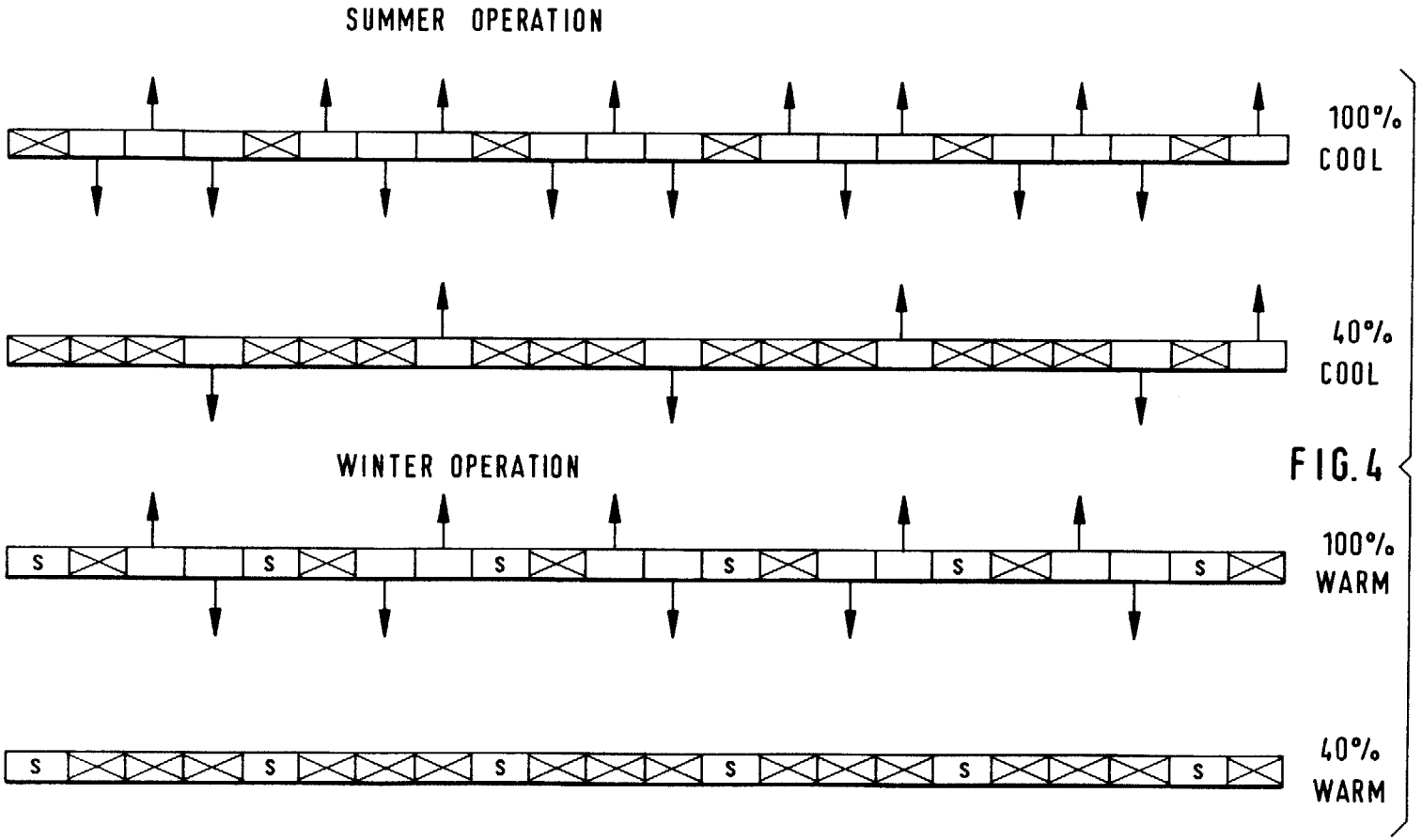
FIG. 4 is a schematic diagram illustrating a number of different configurations of the air outlet ducts in a top view.

FIG. 4 is a top view of the outlet slot 16 in schematic form. Each of the ducts 20 includes an air guide vane 22 which is adjusted in the illustration of FIG. 4 in the following manner beginning with the left part of the figure:

Duct 1: The air stream is vertically downward (marked by s in FIG. 4).

Duct 2: The air is blown adjacent to the ceiling surface to the left (indicated by an arrow in FIG. 4).

Duct 3: The air is blown adjacent to the ceiling to the right.

Duct 4: The air is blown adjacent to the ceiling to the left.

Duct 5: The air is blown perpendicular downwardly.

Duct 6: The air is blown adjacent to the ceiling to the right, etc.

In the topmost illustration of FIG. 4, the air outlet is shown in operation during the summer season under a 100% thermal load. The actuator 40 has displaced the first plate 38 to the left thereby causing the first control slide 24 to close off all of the ducts 20 whose air guide vanes 22 would guide the air stream vertically downward. This position of the first plate of the first control slide 24 corresponds to summer season operation because warm air is blown vertically downwardly into the air space while cold air required for cooling in the summer season is blown into the room at an angle less than 45° from the ceiling.

The second and third control slides 26 and 28 are moved completely to the left in the topmost illustration of FIG. 4 so that their covering surfaces 32, 34 are congruent with respect to the covering surfaces 30 of the first control slide 24. Thus all three control slides 24, 26 and 28 obturate only those ducts through which air would be blown vertically downward. All the ducts 20 lying therebetween and containing vanes which guide the air at a shallow angle with respect to the ceiling are fully opened. Accordingly, the cold air can exit into the room through a maximum outlet opening cross section. The configuration in the topmost diagram thus corresponds to a 100% cooling mode.

The leftward displacement of the second and third control slides 26, 28 is effected by the second actuator 46 which displaces the second plate 42 to the left. During that displacement, the third control slide 28 is initially moved to the left until its covering surface 34 makes contact with the right catch tab 50 whereupon the second control slide 26 is carried to the left in the ensuing motion.

If the thermal load in summer operation is reduced, for example to 40%, the thermostatic controlller causes the second actuator 46 to pull the second plate 42 to the right. This motion causes a rightward motion of the third control slide 28 which continuously closes the outlet cross section of those ducts which are adjacent to the right of the ducts with vertical exit vanes. Once the third control slide 28 has moved to the right by one duct width, its cover surface 34 makes contact with the left catch tab 22 so that any further motion of the second plate 42 to the right also carries along the second control slide 26 in the same direction.

Once the second plate 42 has been moved to the right by two complete duct widths, the apparatus assumes the configuration illustrated in the second line from the top of FIG. 4, which is equivalent to the configuration illustrated in FIG. 1. In that configuration, the first control slide 24 closes off all the ducts through which air is blown vertically downwardly while the second control slide 26 closes off the nearest neighbors to the right and the third control slide 28 closes off the next-nearest neighboring ducts to the right. Accordingly, only every fourth duct permitting sideways air flow is left open. The overall outlet cross section of the entire air outlet slot is thus reduced in accordance with the reduced volumetric flow rate but the cold air is admitted with the same unchanged outlet velocity and the overall cooling power is reduced to 40%. The flow of air out of the air outlet in summer operation is illustrated schematically in the top diagram of FIG. 5. The air jets leave the outlet adjacent to the ceiling surface alternating from one side of the slot to the other. No air is blown directly downwardly so as to avoid the aforementioned undesirable sensations of cold drafts.

In the winter season, i.e., when the temperature of the conditioned air lies above the air in the room, the first plate 38 is moved to the right by one duct width. Thus the first control slide 24 opens the downwardly blowing ducts 20. During the motion of the plate 38, the second plate 42 carries along the third control slide 28. If the apparatus is in the configuration illustrated in FIG. 3, the second control slide 26 is also carried along by contact of the covering surface 34 of the third control slide 28 with the left catch tab 52. However, if the control slides are in a configuration in which their covering surfaces 30, 32, 34 are congruent, the second control slide 26 is carried along by contact of the covering surface 30 of the first control slide 24 with the left catch tab 50.

If the thermal load of the space to be heated changes, the actuator 46 moves the second plate 42, thereby changing the position of the second control slide 26 and the third control slide 28 continuously from the configuration of the third illustration of FIG. 4 to that shown in the fourth and lowest illustration of FIG. 4.

In the configuration of the third line of FIG. 4, all the covering surfaces 30, 32 and 34 are congruent so that only every fourth duct is obturated. In that configuration, hot air is blown directly downwardly as well as to both sides along the ceiling as shown in the central scheme of FIG. 5. This configuration results in the maximum heating power. The lowermost illustration of FIG. 4 is one in which the three control slides 24, 26 and 28 obturate all of the ducts 20 that guide air along the ceiling and leave open only those ducts which blow air directly downwardly. This air flow is illustrated schematically in the lower part of FIG. 5 and corresponds to a heating power of 40%.

The apparatus is changed over from winter season operation to summer season operation in the following way. The first actuator 40 returns the first plate 38 into the position of FIG. 1, i.e., by one duct width to the left. During that motion the first plate 38 moves the first control slide 24 while the second plate 42 moves the third control slide 28. If the closing surfaces 30, 32, 34 of all slides are congruent, the second control slide 26 is moved to the left by contact of the covering surface 34 of the control slide 28 with the right catch tab 50. However, if the covering surfaces of the various control slides are mutually displaced, the second control slide 26 is carried along by contact of the covering surface 30 of the first control slide 24 with the right catch tab 52.

Figure 5:
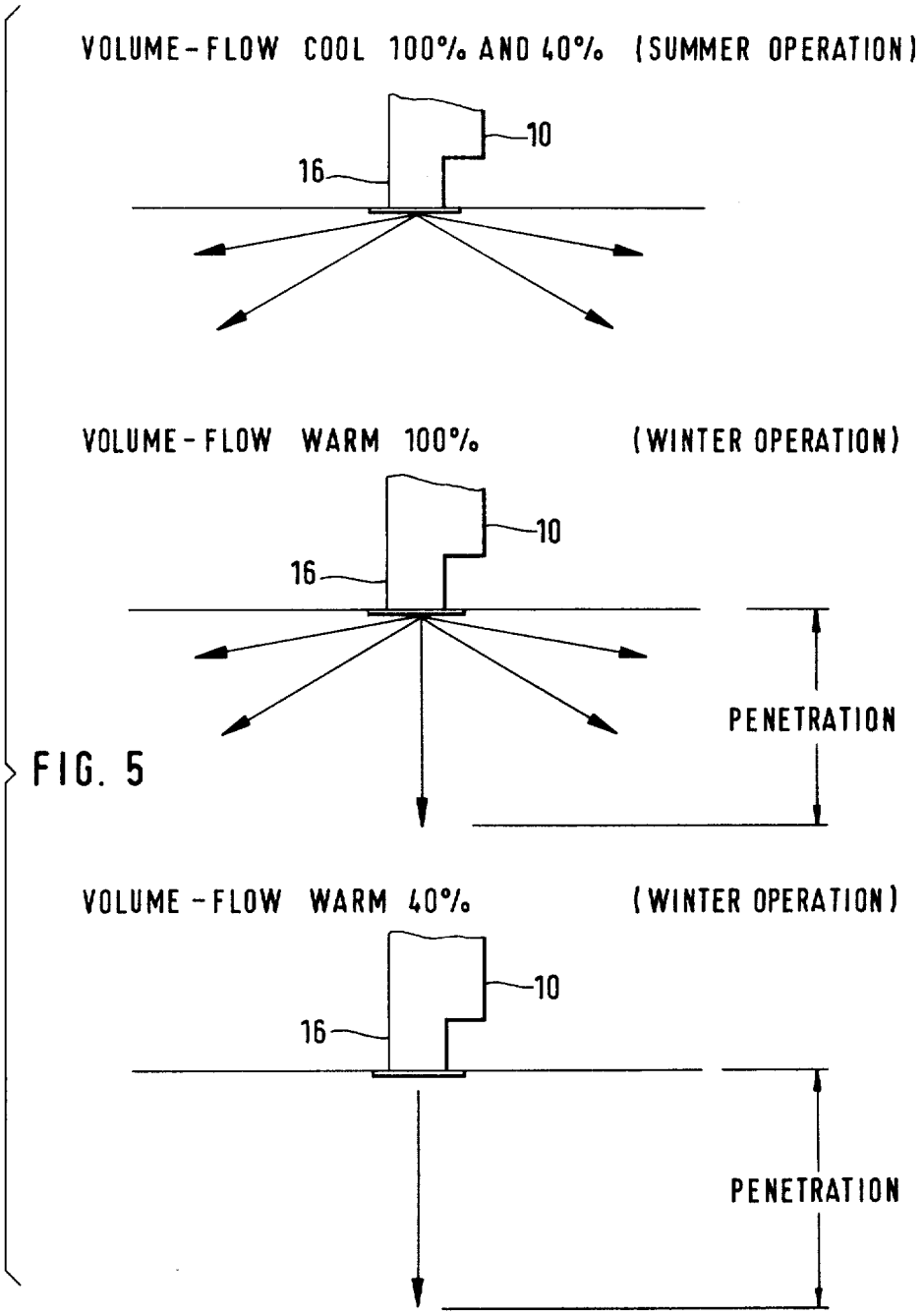
FIG. 5 is a set of diagrams illustrating various positions of the air outlet in a side view showing directions of emerging air flow.

The various advantages of the air outlet according to the invention emerge from the illustration of FIGS. 4 and 5. It will be seen there that during the summer season, when only cooled air is admitted to the room, the air flow is confined to directions lying within relatively shallow angles (approximately 45° ) from the surface adjacent to the air duct, usually the ceiling and this air flow is maintained independently of the magnitude of the air flow and the volumetric rate. Accordingly, the undesirable phenomena of cold drafts are prevented. Furthermore, the air is admitted at a constant outlet speed so that the air stream does not move away from the ceiling. The effective outlet opening of the air outlet can be changed continuously (steplessly) according to the desired volumetric rate and is divided evenly to both sides of the slot as illustrated in FIG. 4. Accordingly, the air outlet maintains uniform air distribution independently of the adjusted volumetric rate.

In the winter season, at least some warm air is always emerging directly downwardly while the change in the volumetric rate is effective only upon those air jets which emerge adjacent to the ceiling. The exit velocity of the warm air emerging vertically downwardly is held constant and hence the depth of penetration of that air into the inhabited space of the room is also constant. The warm air emerging from the outlet to either side of the ceiling is evenly distributed while its volume is steplessly variable to correspond to the thermal load on the system.

The foregoing description relates to a preferred exemplary embodiment of the invention which is subject to a variety of changes, modifications, etc. lying within the competence of a person skilled in the art and without departing from the scope of the invention.

We claim:

1. An air outlet for the ventilation of rooms, spaces and the like, adapted for connection to a source of conditioned air, said air outlet including a distribution box having an outlet slot open to one of said rooms or spaces, said slot being subdivided into individual ducts and provided with a plurality of air guide vanes for directing the air flow through said ducts, said air outlet further including at least a first air control slide disposed within said distribution box for selectably obturating said ducts, and wherein, according to the invention, said outlet slot is subdivided into individual ducts by a plurality of transverse bridges;

each of said ducts is associated with a separate, individually adjustable one of said air guide vanes;

there are provided second and third air control slides, disposed in parallel and in superposition with said first control slide, said first, second and third air control slides being capable of limited axial movement with respect to one another and with respect to said air distribution box, each of said air control slides having a plurality of duct covers, the size of which is substantially equal to the flow cross section of one of said air ducts, said duct covers being disposed at an axial distance from one another equal to four times the distance between adjacent air ducts.

2. An air outlet according to claim 1, further comprising a first pusher plate, disposed in said distribution box and capable of axial movement, said first air control slide being fixedly attached to said first pusher plate and said second and third air control slides being movably coupled thereto.

3. An air outlet according to claim 2, further comprising a second pusher plate slidably disposed on said first pusher plate and attached to said third control slide, said second control slide having a plurality of catch tabs for engaging at least one edge of a duct cover of said third control slide as well as engaging a duct cover of said first control slide one duct width away from the engagement with said third control slide.

4. An air outlet according to claim 3, wherein said pusher plates are disposed within said air distribution box.

5. An air outlet according to claims 3 or 4 wherein said first control slide is attached to said first pusher plate by a first bracket and said third control slide is attached to said second pusher plate by a second bracket.

6. An air outlet according to claim 1, further comprising actuator means for slidably displacing said control slides.

7. An air outlet according to claim 6, further comprising thermostatic control means for controlling the operation of said actuator means.

8. An air outlet according to claim 6, wherein said actuator means includes a first actuator, attached to said distribution box, for engaging said first pusher plate and a second actuator, attached to said first pusher plate, for engaging said second pusher plate.

9. An air outlet according to claim 1, wherein the axial movement of said first control slide extends at least over one duct width such that, in one of its terminal positions, its duct covers obturate those of said air ducts in which said air guide vanes direct air to flow perpendicularly out of said air slot and wherein the air guide vanes of all other of said air ducts are so adjusted as to direct the air at an angle of less than 45° with respect to the wall surface in which said air outlet is installed, in alternating respective directions.

* * * * *